US011644165B2

(12) United States Patent
Ma et al.

(10) Patent No.: US 11,644,165 B2
(45) Date of Patent: May 9, 2023

(54) LAMP FOR WATER MIST IN THE SHAPE OF A FLAME

(71) Applicant: INTERTEC TECHNOLOGY LIMITED

(72) Inventors: Hing Kin William Ma, Wanchai (HK); Naxin Wang, Wanchai (HK)

(73) Assignee: INTERTEC TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 17/838,768

(22) Filed: Jun. 13, 2022

(65) Prior Publication Data

US 2022/0403993 A1 Dec. 22, 2022

(30) Foreign Application Priority Data

Jun. 17, 2021 (CN) ..... 202121351241.2

(51) Int. Cl.

| | |
|---|---|
| ***F21S 10/00*** | (2006.01) |
| ***F21S 10/04*** | (2006.01) |
| ***F21V 23/00*** | (2015.01) |
| ***F21V 23/06*** | (2006.01) |
| ***F21V 31/03*** | (2006.01) |
| *F21Y 115/10* | (2016.01) |

(52) U.S. Cl.

CPC ..... *F21S 10/002* (2013.01); *F21S 10/04* (2013.01); *F21V 23/003* (2013.01); *F21V 23/06* (2013.01); *F21V 31/03* (2013.01); *F21Y 2115/10* (2016.08)

(58) Field of Classification Search

None

See application file for complete search history.

(56) References Cited

FOREIGN PATENT DOCUMENTS

CA 3022601 A1 * 4/2019 ..... B05B 17/0615
CN 203836916 U * 9/2014

* cited by examiner

*Primary Examiner* — Elmito Breval

(74) *Attorney, Agent, or Firm* — Medler Ferro Woodhouse & Mills PLLC

(57) ABSTRACT

The present disclosure discloses a lamp for water mist in the shape of a flame, which includes a base, wherein a water tank is arranged on the top of the base, an ultrasonic atomizer is provided at the bottom of the water tank, an upwardly protruding component is centrally arranged at the bottom of the water tank, a plurality of supporting blocks are arranged at the bottom of the spacer plate near the through hole, and a baffle plate is arranged between the supporting blocks and the protruding component, a channel is formed between the spacer plate and the baffle plate, and a plurality of LED lights are provided on the top of the water tank, a housing is provided outside the water tank, the top part of the housing is provided with a top cover having a lamp hole.

8 Claims, 4 Drawing Sheets

LAMP FOR WATER MIST IN THE SHAPE OF A FLAME

CROSS-REFERENCE TO RELATED APPLICATIONS

This application claims priority to Chinese Utility Application No. 202121351241.2, filed on Jun. 17, 2021. The disclosure of the application is incorporated herein for all purposes by reference in its entirety.

TECHNICAL FIELD

The present disclosure relates to the technical field of lighting, and more particularly, to a lamp for water mist in the shape of a flame.

BACKGROUND

In order to set off the atmosphere of the scene, flame lamps are widely used on the stage and in daily life. However, the open flame of the flame lamp has a great safety hazard, especially in densely populated cities. Once it catches fire, it will cause immeasurable losses to life and property. Therefore, there is a need for an imitation flame lamp with high safety and realistic effect. Most of the existing flame lamps have the characteristics of complex structure and insufficient simulation, and need to be improved.

SUMMARY

In order to overcome the deficiencies of the existing technology, the present disclosure provides a lamp for water mist in the shape of a flame, which has the advantages of simulating flame effect, novel structure, safety and environmental protection.

The technical scheme adopted by the present disclosure to solve its technical problems is:

A lamp for water mist in the shape of a flame, which includes a base, wherein a water tank is arranged on a top part of the base to store water, and an ultrasonic atomizer is arranged at a bottom part of the water tank to atomize the water, the top part of the water tank is provided with a plurality of LED lights for lighting, a housing is provided outside the water tank to protect the internal structure, a top cover is provided on a top part of the housing, and a lamp hole is provided on the top cover for diffusing light and dispersing water mist.

As an improvement of the above technical solution, a plurality of first connecting shafts are arranged at the bottom part of the water tank, the base is provided with a plurality of first connecting holes for receiving the first connecting shaft to stabilize the water tank.

As an improvement of the above technical solution, a spacer plate is clamped at a top edge of the water tank, and a through hole is provided at a center of the spacer plate, and the through hole communicates with the lamp hole, thereby being convenient for the light emitted by the LED light to spread out from the through hole and the lamp hole, and convenient for the water mist to spread out.

As an improvement of the above technical solution, an upwardly protruding component is arranged in a middle of the bottom part of the water tank, and a plurality of supporting blocks are arranged at a bottom part of the spacer plate near the through hole, a baffle plate is arranged between the supporting block and the protruding component to stabilize the position of the spacer plate, a channel is formed between the spacer plate and the baffle plate, thereby being convenient for the water in the water tank to be atomized by the ultrasonic atomizer, and the water mist will diffuse to the outside through the through hole and the corresponding lamp hole through the channel.

As an improvement of the above technical solution, the top part of the housing is concave towards its interior, and the concave part is connected with the spacer plate, the top cover is mounted to the concave part at the top part of the housing and is fitted with it, thus the lamp hole on the top cover is connected to the through hole on the spacer plate.

As an improvement of the above technical solution, a plurality of second connecting shafts are arranged at a bottom part of the top cover, and the second connecting shafts extend through the top part of the housing, a top part of the spacer plate is provided with a plurality of second connecting holes for receiving the second connecting shafts to stabilize the position of the top cover, while also stabilize the position of the spacer plate.

As an improvement of the above technical solution, the bottom part of the water tank is provided with a ventilation hole extending from the bottom towards the top of the water tank, and the bottom part of the base is provided with air holes, a fan is arranged on the inner wall of the ventilation hole to guide the water mist atomized by the ultrasonic atomizer, the fan and the air hole are configured to allow the air flow caused by the rotation of the fan to blow upwards through the ventilation hole, and air flow is then blocked by the spacer plate and flows horizontally, thereby driving the water mist to pass through the channel and then through the through hole and the air hole to spread out.

As an improvement of the above technical solution, a power amplifier circuit module is arranged between the base and the water tank, thereby realizing the function of each structure.

As an improvement of the above technical solution, the housing is provided with a remote controller used to control this device, and the housing is provided with a mounting hole, the outside of the water tank is provided with a mounting groove on its external surface, the mounting hole aligns with the mounting groove, so that the remote controller is mounted in the mounting groove through the mounting hole, the water tank is made of transparent material, after the remote-control is removed, the water volume inside the water tank can be observed from the mounting groove, so that water can be added in a planned way.

The beneficial effects of the present disclosure are: the present disclosure provides a lamp for water mist in the shape of a flame, the water mist formed by the atomization of the water in the water tank by the ultrasonic atomizer is cooperated with light diffused by the LED light, it can create a flame-like effect, and has a strong artistic effect, at the same time, the remote controller is removably received in the mounting groove on the water tank, thereby not only saving space, but also facilitating the placement of the remote controller, and being not easy to lose the remote controller, user can also observe water volume in the water tank, thus adding water in time to create a flame effect.

BRIEF DESCRIPTION OF THE DRAWINGS

The present disclosure will be further described below in conjunction with the accompanying drawings and embodiments.

REFERENCE NUMERALS

1. base; 11. first connecting hole;
2. water tank; 21. first connecting shaft; 22. protruding component; 23. ventilation hole; 24. fan;
3. ultrasonic atomizer;
4. LED light;
5. housing;
6. top cover; 61. lamp hole; 62. second connecting shaft;
7. spacer plate; 71. second connecting hole; 72. through hole; 73. supporting block; 74. channel;
8. baffle plate;
9. remote controller.

DETAILED DESCRIPTION

The concept, specific structure and technical effects of the present disclosure will be clearly and completely described below with reference to the embodiments and accompanying drawings, so as to fully understand the purpose, features and effects of the present disclosure. Apparently, the described embodiments are only a part of the embodiments of the present disclosure, but not all of the embodiments, based on the embodiments of the present disclosure, other embodiments obtained by those skilled in the art on the premise of no creative work fall within the protection scope of the present disclosure. In addition, all the coupling/connecting relationships involved in the application not only mean that the components are directly connected, but also refer to a better coupling structure by adding or reducing coupling accessories according to the specific implementation. Various technical features in the present disclosure can be combined interactively on the premise of not contradicting each other.

Figure 1:
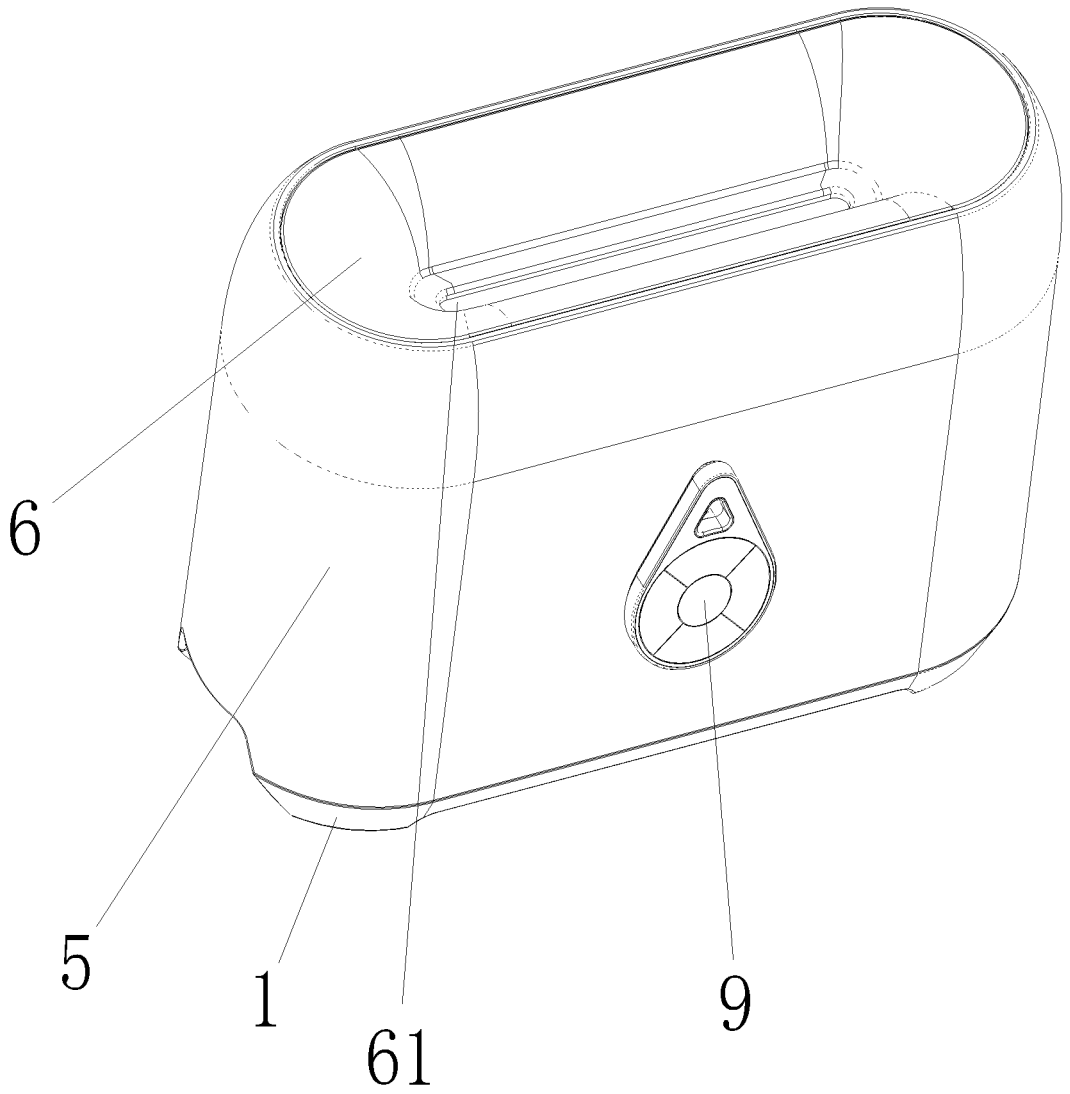
FIG. 1 is a schematic diagram of the three-dimensional structure of the present disclosure.
Figure 2:
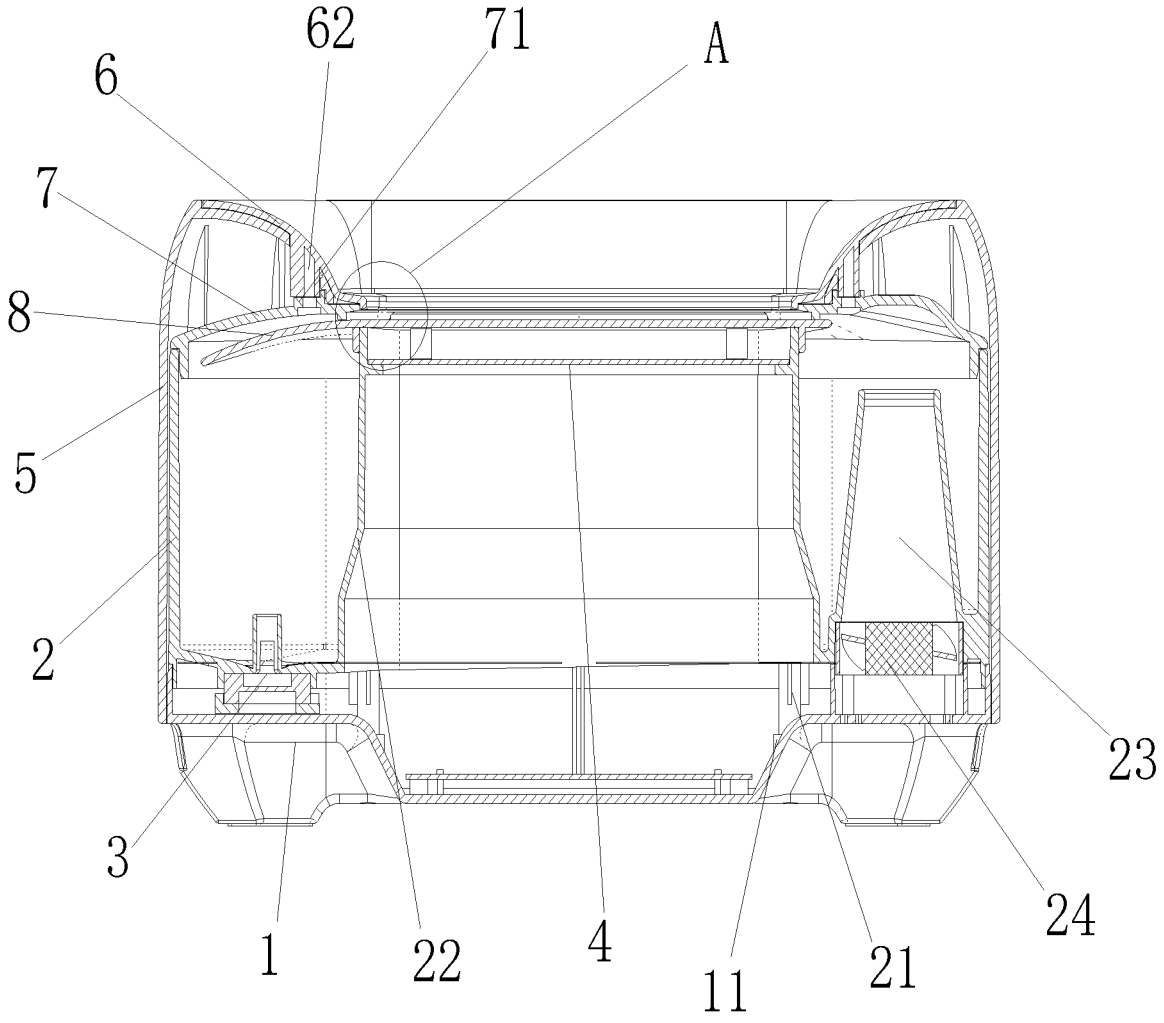
FIG. 2 is a sectional view of the present disclosure.
Figure 3:
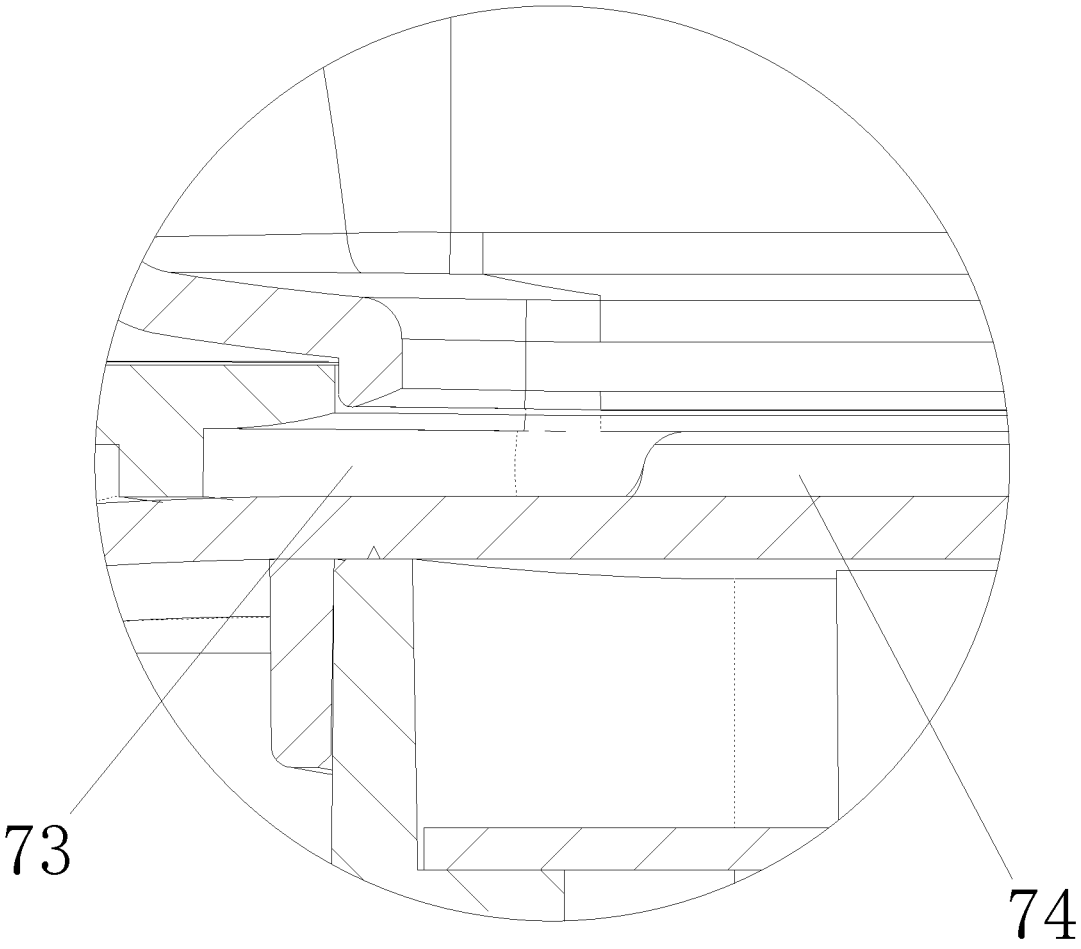
FIG. 3 is a partial enlarged view of part A in FIG. 2.
Figure 4:
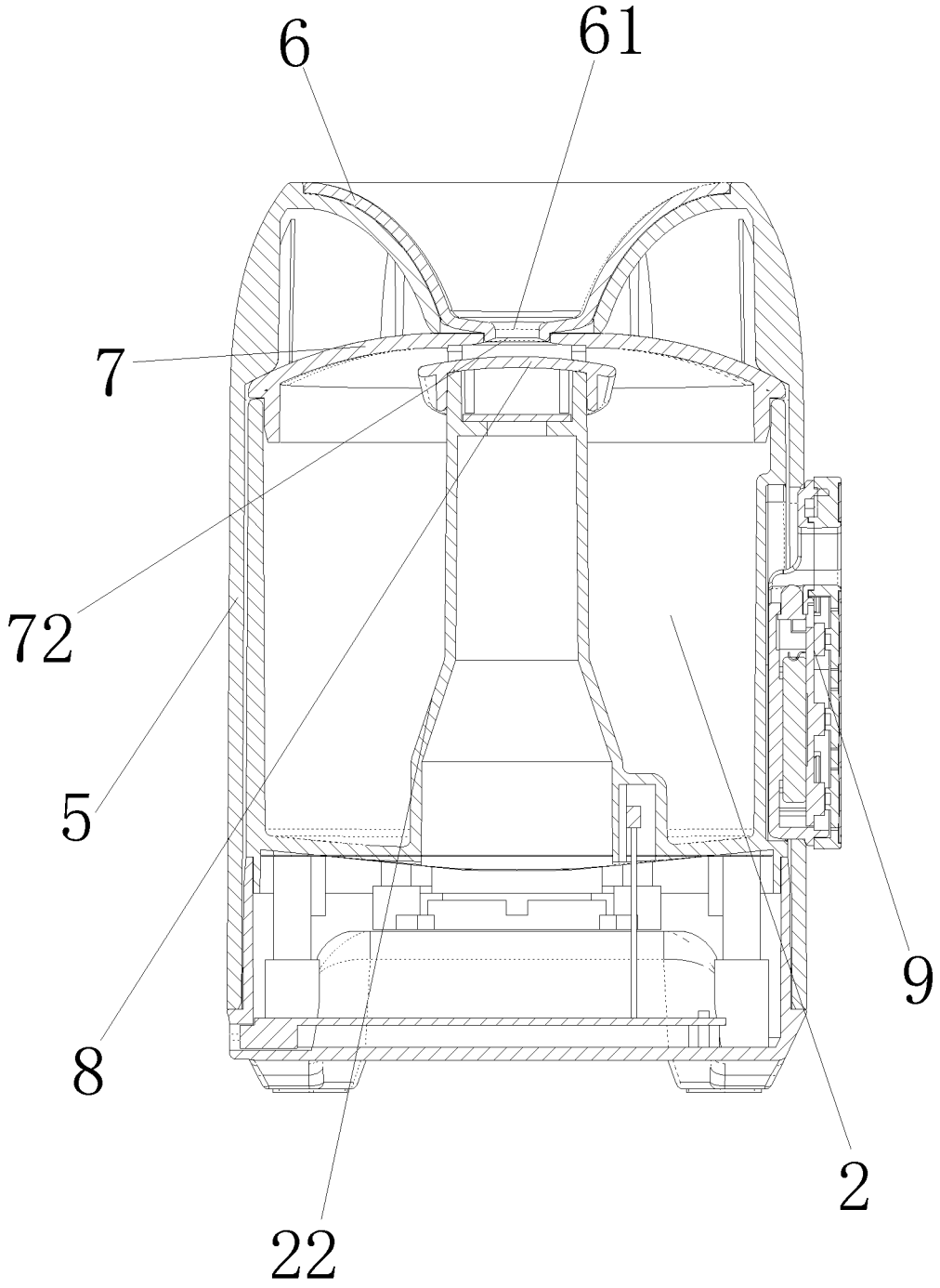
FIG. 4 is another sectional view of the present disclosure.

Referring to FIGS. 1 to 4, a lamp for water mist in the shape of a flame includes a base 1, and a water tank 2 is provided on the top of the base 1 to store water, the water tank 2 is provided with an ultrasonic atomizer 3 at its bottom to atomize the water, the top part of the water tank 2 is provided with a plurality of LED lights 4 for lighting, a housing 5 is provided outside the water tank 2 to protect the internal structure. The top part of the housing 5 is provided with a top cover 6, and the top cover 6 is provided with a lamp hole 61 for diffusing light and dispersing water mist.

The bottom part of the water tank 2 is provided with a plurality of first connecting shafts 21, and the base 1 is provided with a plurality of first connecting holes 11 for cooperating with the first connecting shafts 21 to stabilize the water tank 2.

A spacer plate 7 is clamped by the water tank 2 at the top edge of the water tank 2, and a through hole 72 is provided at the center of the spacer plate 7. The through hole 72 communicates with the lamp hole 61, so that the light emitted by the LED lights 4 can pass through the through hole 72 and the lamp hole 61, and it is also convenient for the water mist to spread out.

An upwardly protruding component 22 is centrally arranged at the bottom of the water tank 2, and a plurality of supporting blocks 73 are arranged at the bottom part of the spacer plate 7 near the through hole 72, a baffle plate 8 is arranged between the supporting blocks 73 and the protruding component 22 to stabilize the spacer plate 7, a channel 74 is formed between the spacer plate 7 and the baffle plate 8, after the water in the water tank 2 is atomized by the ultrasonic atomizer 3, the resulting water mist passes through the channel 74, and passes through the through hole 72 and the corresponding lamp hole 61 and is diffused to the outside.

The top part of the housing 5 is concave towards its interior, and the concave part is connected with the spacer plate 7, the top cover 6 is mounted to the concave part at the top part of the housing 5 and fits with it, so that the lamp hole 61 of the top cover 6 and the through hole 72 of the spacer plate 7 are communicated.

The bottom part of the top cover 6 is provided with a plurality of second connecting shafts 62, and the second connecting shafts 62 penetrate or extend through the top part of the housing 5, the top part of the spacer plate 7 is provided with a plurality of second connecting holes 71 for receiving the corresponding second connecting shafts 62, thereby stabilizing the top cover 6 and the spacer plate 7.

The water tank 2 is provided with a ventilation hole 23 extending from the bottom towards the top of the water tank, the bottom of the base 1 is provided with an air hole, and a fan 24 is arranged on the inner wall of the ventilation hole 23 to guide the water mist atomized by the ultrasonic atomizer 3, the ventilation hole 23, the fan 24 and the air hole are configured to allow the air flow caused by the rotation of the fan 24 to blow upwards through the ventilation hole 23, and air flow is then blocked by the spacer plate 7 and flows horizontally, thereby driving the water mist to pass through the channel 74 and then through the through hole 72 and the lamp hole to spread out.

A power amplifier circuit module is arranged between the base 1 and the water tank 2 to realize the functions of each structure.

The housing 5 is provided with a remote controller 9 for controlling the device, and the housing 5 is provided with a mounting hole, the water tank 2 has a mounting groove on its external surface, the mounting hole aligns with the mounting groove, so that the remote controller 9 is mounted in the mounting groove through the mounting hole. The water tank 2 is made of transparent material, after the remote controller 9 is removed, the water volume inside the water tank 2 can be observed from the mounting groove, so that water can be added in a planned way.

When using the lamp according to this present disclosure, firstly, the ultrasonic atomizer 3 converts the water in the water tank 2 into water mist, at this time, driven by the fan 24, the air flow is blown upward through the ventilation hole 23, blocked by the spacer plate 7 and flows horizontally, thereby driving the water mist to pass through the channel 74 and then through the through hole 72 and the air hole to spread out. Since the LED light 4 keeps the light on, the light emitted by the LED light 4 illuminates the through hole 72 and the lamp hole 61, and the combination of the light and the water mist will create a flame atmosphere, which has a strong artistic effect.

The above is a specific description of the preferred embodiments of the present disclosure, but the present disclosure is not limited to the described embodiments, those skilled in the art can make various equivalent modifications or substitutions without departing from the concept of the present disclosure, and these equivalent modifications or substitutions are all included within the scope defined by the claims of the present application.

The invention claimed is:

1. A lamp for water mist in the shape of a flame, comprising a base, wherein a water tank is arranged on a top of the base to store water, and an ultrasonic atomizer is arranged at a bottom of the water tank to atomize the water, the water tank is provided with a plurality of LED lights at its top, a housing is provided outside the water tank, a top cover is provided on a top of the housing, and a lamp hole is provided on the top cover for the passage of light and water mist, wherein a plurality of first connecting shafts are arranged at the bottom of the water tank, and the base is provided with a plurality of first connecting holes for receiving the first connecting shafts to stabilize the water tank.

2. The lamp of claim 1, wherein a spacer plate is clamped by the water tank at a top edge of the water tank, and a through hole is provided at a center of the spacer plate, and the through hole communicates with the lamp hole.

3. The lamp of claim 2, wherein an upwardly protruding component is centrally arranged at the bottom of the water tank, and a plurality of supporting blocks are arranged at a bottom of the spacer plate near the through hole, a baffle plate is arranged between the plurality of supporting blocks and the protruding component to stabilize the spacer plate, a channel is formed between the spacer plate and the baffle plate.

4. The lamp of claim 3, wherein a top part of the housing is concave towards its interior, and the concave top part is connected with the spacer plate, wherein the top cover is mounted to the concave top part and fits with it.

5. The lamp of claim 4, wherein a plurality of second connecting shafts are arranged at a bottom of the top cover, and the plurality of second connecting shafts extend through the top part of the housing, wherein the spacer plate has a plurality of second connecting holes at its top for receiving the plurality of second connecting shafts to stabilize the top cover.

6. The lamp of claim 1, wherein the water tank is provided with a ventilation hole extending from the bottom towards the top of the water tank, and the base is provided with air holes at its bottom, and wherein a fan is arranged on an inner wall of the ventilation hole to guide the water mist atomized by the ultrasonic atomizer.

7. The lamp of claim 1, wherein a power amplifier circuit module is arranged between the base and the water tank.

8. The lamp of claim 1, wherein the housing is provided with a remote controller, and the housing is provided with a mounting hole, the water tank has a mounting groove on its external surface, and the mounting hole aligns with the mounting groove such that the remote controller is mounted in the mounting groove through the mounting hole.

* * * * *